United States Patent [19]

Spector

[11] Patent Number: 4,571,485

[45] Date of Patent: Feb. 18, 1986

[54] CUBE TYPE AROMA GENERATOR

[76] Inventor: Donald Spector, 380 Mountain Rd., Union City, N.J. 07087

[21] Appl. No.: 664,536

[22] Filed: Oct. 25, 1984

[51] Int. Cl.[4] ..... F22B 1/28

[52] U.S. Cl. ..... 219/276; 219/274; 219/272; 239/136

[58] Field of Search ..... 219/271, 272, 273, 274, 219/275, 276, 521, 214; 239/34, 35, 45, 47, 53, 54, 55, 56, 60, 135, 136

[56] References Cited

U.S. PATENT DOCUMENTS

| | | | |
|---|---|---|---|
| 2,513,919 | 7/1950 | Costello | 219/272 |
| 2,616,024 | 10/1952 | Laibow | 219/272 |
| 2,896,853 | 7/1959 | Curran | 239/60 |
| 2,942,090 | 6/1960 | Diehl | 219/271 |
| 2,988,284 | 6/1961 | Smith | 239/60 |
| 3,575,346 | 4/1971 | Roth | 239/54 |
| 3,895,928 | 7/1975 | Moran | 219/271 |
| 4,361,279 | 11/1982 | Beacham | 239/56 |
| 4,467,177 | 8/1984 | Zobele | 219/276 |

*Primary Examiner*—C. L. Albritton

*Assistant Examiner*—Teresa J. Walberg

*Attorney, Agent, or Firm*—Michael Ebert

[57] ABSTRACT

An aroma generator for discharging aromatic vapors into the atmosphere. The generator is constituted by a replaceable aroma cube insertable into the well of a heater unit having a heater element positioned at the base of the well. The cube takes the form of an open-ended chimney having a shallow box coaxially supported therein at its lower end to define an outlet air passage in the spaces therebetween, the underside of the box being open to expose its interior to heat emitted by the base heater. Held within the box is a pad saturated with a volatile aromatic liquid, the box and the pad having a center hole therein to form an inlet air passage. Because of the pressure differential in the chimney created by the heated and expanding air at the lower end thereof, relatively cool air in the chimney is drawn downwardly through the inlet air passage and is heated by the base heater. This produces a convection stream of hot air that flows across the pad to volatilize the liquid, the resultant aromatic vapors being discharged into the atmosphere through the outlet passage.

9 Claims, 6 Drawing Figures

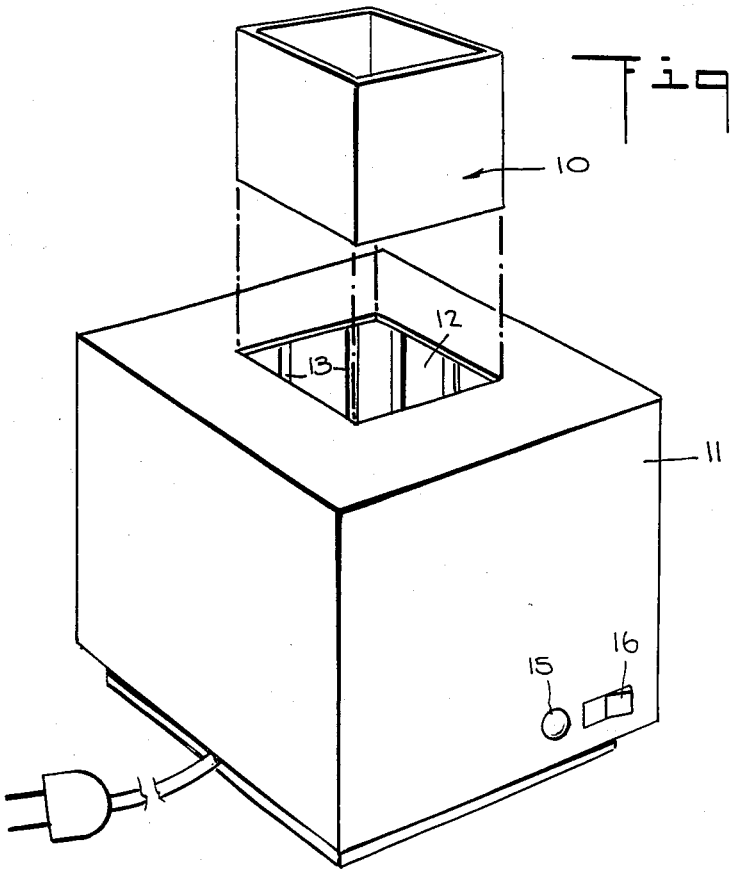
Fig. 1.
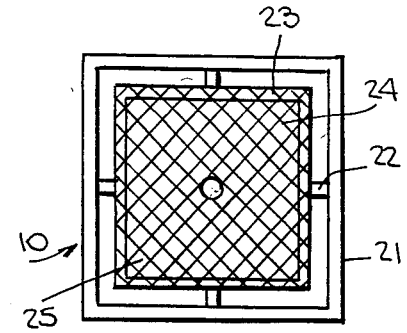
Fig. 5.
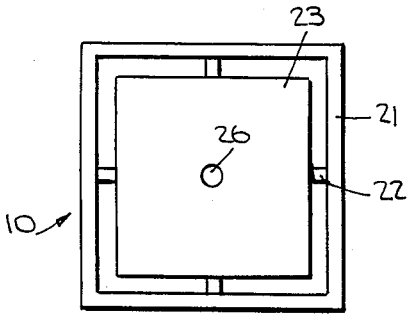
Fig. 6.
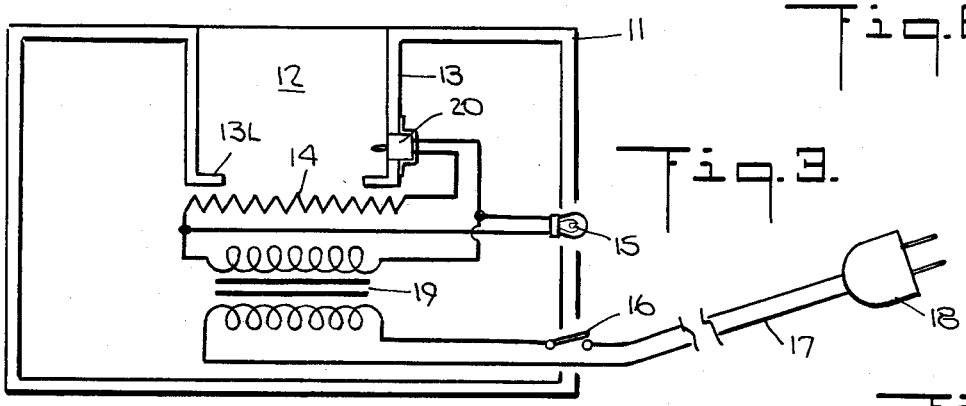
Fig. 3.
Fig. 4.
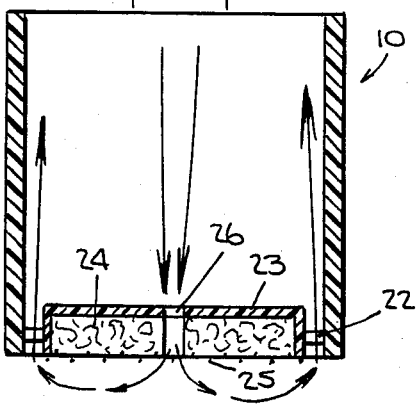
Fig. 2.
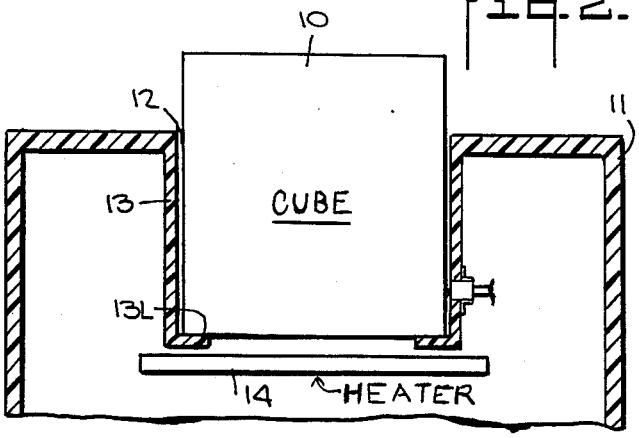

CUBE TYPE AROMA GENERATOR

BACKGROUND OF INVENTION

1. Field of Invention

This invention relates generally to aromatic generators, and more particularly to a generator constituted by a replaceable aroma cube insertable into the well of a heater unit having a heater element positioned at the base of the well to produce convection currents of heated air which act to volatilize an aromatic liquid contained in the cube.

2. State of the Art

As used herein, the term "aroma" is not limited to pleasant or savory smells, but encompasses scents that function as insecticides, air fresheners, deodorants or any other odor that acts to condition, modify or otherwise charge the atmosphere.

The aroma of perfumes and perfume-based products such as colognes and toilet waters was originally derived from the essential oil of plants. However, since the early 19th century, chemists have succeeded in analyzing many essential oils and in creating thousands of synthetics, some simulating natural products and others yielding altogether new scents. Perfumes today are largely blends of natural and synthetic scents and of fixatives which equalize vaporization and enhance pungency. In most liquid scents the ingredients are combined with alcohol.

In my prior U.S. Pat. No. 4,200,229, entitled "Aroma-Dispensing Cartridge and Holder Assembly", the assembly is designed for installation in an automobile interior for charging this interior with a pleasant or stimulating fragrance. The cartridge includes a bottle filled with a liquid scent, a suction pump being supported on the stopper of the bottle. When actuated, the pump sprays the scent onto a pad of absorbent material.

The difficulty with an aroma dispenser which functions to spray a charge of liquid onto a pad of absorbent material is that at ambient temperature the liquid, even when it has a high alcohol content, is slow to volatilize; hence the resultant odor, though of sufficient strength in the confines of an automotive interior, may lack adequate intensity in those environments which are relatively open, such as the living room or bedroom of a home.

With a view to accelerating the volatilization of aromatic and other liquids, it is known to use a heater for this purpose Thus in the Cartwright U.S. Pat. No. 2,501,496, there is disclosed an arrangement in which a pan containing a sterilizing liquid is supported above an electric light bulb, the resultant convection currents being directed to flow across the surface of the liquid to promote its volatilization.

In the U.S. Pat. No. 4,214,146 to Schimanski, a pad saturated with a liquid insecticide is placed on an electrical heater plate. And in the deodorizer shown in the Dieh U.S. Pat. No. 2,942,090, vapor-disseminating deodorant tablets are subjected to convection currents of heated air. Also of interest is the U.S. Pat. No. 3,872,280 of Van Dalen in which an electrical heater produces convection currents that flow past vaporizer elements.

One practical drawback which characterizes all such prior art arrangements is that the user cannot readily switch from one aroma to another, for the aroma-producing elements are not easily replaceable. If, therefore, the user, in manipulating the environment of a room, wishes to effectively deodorize the pungent aroma produced by the unit or to displace this aroma with a distinctly different aroma, he cannot do so without difficulty.

Another drawback of existing aroma generators is that they are strictly utilitarian in appearance and are therefore not acceptable for installation in a living room or other domestic or office environment in which such devices would be in conflict with the prevailing decor.

SUMMARY OF INVENTION

In view of the foregoing, the main object of this invention is to provide an improved aroma generator which discharges aromatic vapors into a room to modify, condition or otherwise change the atmosphere therein.

More particularly, an object of this invention is to provide an aroma generator which makes use of replaceable aroma cubes, each emitting a different fragrance when subjected to heat, so that the user may select one of many aromas and quickly transfer from one aroma to another at will.

Still another object of the invention is to provide an extremely simple and attractive aroma generator which may be installed in a living room or other non-industrial environment in which generators having a utilitarian appearance are not accept- able.

Also an object of this invention is to provide an aroma generator which operates reliably and efficiently.

Briefly stated, these objects are attained in an aroma generator for discharging aromatic vapors into the atmosphere. The generator is constituted by a replaceable aroma cube insertable into the well of a heater unit having a heater element positioned at the base of the well. The cube takes the form of an open-ended chimney having a shallow box coaxially supported therein at its lower end to define an outlet air passage in the spaces therebetween, the underside of the box being open to expose its interior to heat emitted by the base heater. This produces a convection stream of hot air that flows across the pad to volatilize the liquid, the resultant aromatic vapors being discharged into the atmosphere through the outlet passage.

OUTLINE OF THE DRAWINGS

For a better understanding of the inventionn as well as other objects and further features thereof, reference is made to the following detailed description to be read in conjunction with the accompanying drawings, wherein:

FIG. 1 is a perspective view of the aroma cube and a heater unit therefor which together form an aroma generator in accordance with the invention;

FIG. 2 is a section taken through the upper section of the heater unit;

FIG. 3 is a schematic representation of the heater unit;

FIG. 4 is a longitudinal section taken through the cube;

FIG. 5 is a bottom view of the cube; and

FIG. 6 is a top view of the cube.

DESCRIPTION OF THE INVENTION

Referring now to the drawing, an aroma generator in accordance with the invention is constituted by an aroma cube, generally designated by numeral 10, and an electrical heater unit, generally designated by numeral 11 having a cube-shaped housing.

Cube 10 is insertable in a square-shaped well 12 having matching dimensions whose entry is on the top wall of heater unit 11. The sides of the well are formed by vertical ribs 13 whose lower ends are provided with ledges 13L to retain the inserted cube just above a base heater element 14 in planar form. Thus as shown in FIG. 2, when cube 11 is received in well 12, it rests on ledges 13L, the upper end of the cube then protruding somewhat above the top wall of the heater unit 11 so that it can be grasped by the user and readily removed.

The heater unit is provided with a piot light 15 and power switch 16 mounted on a side wall of the housing, as illustrated in FIG. 1. As shown in FIG. 3, power switch 16 is interposed in a cable 17 going to a plug 18 for insertion in an AC power line outlet. Cable 17 is connected within the unit to the primary of a step-down transformer 19 whose secondary winding supplies power to heater element 14. In practice, the heater element may be of the 24 volt type, hence the step-down transformer is designed to reduce the usual 120 volt a-c line voltage to 24 volts. Pilot light 15 is connected across the secondary winding to indicate when the power is switched on. The heater element may be of the resistance wire, quartz or any other type.

A microswitch 20 is connected in series with heater element 14 and the secondary of transformer 17. The microswitch is mounted within well 12 at a side position at which it will be actuated only when it is engaged by a cube 10 inserted in the well. In this way, even though the power is "on", the heater element is normally disconnected, and is only energized when a cube is inserted in the well. This facilitates a quick changeover from one aroma to another, for when one cube is taken out of the unit, the heater is cut off until another cube is inserted, at which point the heater element is again activated.

Cube 10, as shown in FIGS. 4, 5 and 6 is constituted by an open-ended chimney 21 having a square cross-section and formed of a synthetic plastic material of good strength, such as PVC or polypropylene that is heat-resistant.

Supported coaxially within chimney 21 at the lower end thereof by means of spider ribs 22 is a shallow box 23 of the same material, the box being open on its side facing heater element 14. Nested within box 23 is a pad 24 of porous material having good wicking properties. This pad may be made of non-woven fabric, flexible foam plastic, blotting paper or other suitable material. The pad is impregnated with a volatile aromatic liquid and is covered by a wire or plastic net 25 whose margins are secured to the box to retain the pad therein. In practice, the peel-off cover may be placed over net 25 to prevent volatilization of the liquid during prolonged storage.

A center hole 26 is bored in the top wall of box 23, the hole extending through pad 24 to form an air inlet passage. The four side spaces between box 23 and chimney 21 define air outlet passages.

In operation, when heater element 14 is "on", it acts to heat and expand the air thereabove in the lower end of the chimney to create a pressure differential between this air and the cooler air at the upper end of the chimney. As a consequence, as shown by the arrows in FIG. 4, the cool air from the upper end of the chimney is drawn into the inlet passage formed by center hole 26, for the air above the top wall of box 23 is thermally isolated from the heater element below the open side of the box.

The cool air drawn through inlet passage 26 is raised in temperature by the heater element and the resultant convection currents of heated air pass across the exposed surface of impregnated pad 24 to volatilize the aromatic liquid, thereby producing aromatic vapors which pass up the chimney through the outlet passage in the spaces between the box and chimney. These vapors are discharged into the atmosphere to suffuse the room with the aroma. The draft effect created by the chimney results in rapid vaporiza- tion.

In practice, the user is provided with several cubes 10 each having a different aroma, the cubes being so labelled. Thus the user can select whichever aroma is appropriate to a given occasion, and he may from time to time change cubes, or make use of a cube containing a deodorizer to clear the air.

The user need only turn on the power switch when the unit is first put into operation, for thereafter the heater unit is activated only when a cube is inserted. In transferring from one cube to another, the heater is automatically cut off until a cube is in place in the well. Since the aroma unit is highly efficient, it may be desirable to periodically interrupt heater operation to prevent desensitizing the olfactory response of the occupants of the room as will occur when a given aroma in a high concentration is continuously present. To this end, an electronic interrupter (not shown) may be interposed between the heater and the transformer so that the heater is cycled to be "on", for say five minutes and then "off" for ten minutes in each operating period.

Because the cube and the cube-shaped heater unit have the same basic geometry, the appearance thereof is decorative rather than utilitarian and in harmony with modern decorative motifs. Hence the aroma generator may be placed in any home environment without giving offense to the taste of the owner and without revealing its function.

Because the cubes are low cost, they may be discarded after the impregnant is exhausted and replaced with fresh cubes. However, the user may recharge a cube by applying drops of a perfume or any other aromatic liquid to the pad, the liquid being wicked throughout the body of the pad to uniformly saturate it.

Instead of having the cube project somewhat above the well to facilitate manual removal thereof, the wall may be provided with a button-operated eject mechanism. In this way one can eject a cube fully inserted in the well, in which case the upper end of the cube may be made flush with the top wall of heater unit when the generator is in operation.

While there has been shown and described preferred embodiments of CUBE TYPE AROMA GENERATOR in accordance with the invention, it will be appreciated that many changes and modifications may be made therein without, however, departing from the essential spirit thereof.

Thus, while the generator, as shown, is formed by an aroma cube in combination with a cubical heater unit, instead of this geometry one may use a cylindrical form for the chimney, in which case the box held coaxially therein would also be in cylindrical form, and the well in the heater unit will be correspondingly shaped.

I claim:

1. An aroma generator for discharging aromatic vapors into the atmosphere, said generator comprising:

A. a replaceable aroma source formed by an open-ended chimney having a shallow box coaxially supported therein adjacent its lower end to form a space between the box and the chimney, an underside of the box being open, said box having a porous pad nested therein impregnated with an aromatic liquid, a surface of the pad being exposed by the open underside of the box, said box having a top wall provided with a center hole which extends through the pad to define an air inlet passage, the space between the chimney and the box defining an outlet air passage; and B. a heater unit having a well therein for receiving said chimney and having an electrical heater element disposed below the well whereby when the heater element is energized, it heats and expands air thereabove to create a differential pressure in the chimney causing cool air above the top wall of the box to be drawn through the inlet passage toward the heater element to be heated, thereby producing hot air convection currents that pass across the exposed surface of the pad to volatilize the liquid to form aromatic vapors that flow through the outlet passage to be discharged into the atmophere.

2. A generator as set forth in claim 1 wherein said chimney has a square cross section to form a cube-shaped aroma source, and said box is square.

3. A generator as set forth in claim 2 wherein said unit is cube-shaped, and said well has a square cross section.

4. A generator as set forth in claim 3 wherein said well has side walls formed by vertical ribs whose lower ends are provided with ledges to support the inserted chimney.

5. A generator as set forth in claim 1 wherein said heater element is energized through a step-down transformer, and further including a microswitch interposed between a secondary of the transformer and the heater, and disposed in the well to be engaged by said chimney whereby the heater is activated only when the chimney is inserted in the well.

6. A generator as set forth in claim 1 wherein said box is supported by a spider within the chimney.

7. A generator as set forth in claim 1 wherein said pad is covered by a net secured to said box.

8. A generator as set forth in claim 1 wherein a plurality of replaceable aroma sources is provided having different aromatic liquids, giving a user a choice of aromas.

9. A generator as set forth in claim 1 wherein said chimney and said unit have the same geometric form.

* * * * *